US007309077B2

(12) United States Patent
Couderc

(10) Patent No.: US 7,309,077 B2
(45) Date of Patent: Dec. 18, 2007

(54) DEVICE FOR RECEIVING A FOOT OR A BOOT ON A SPORTS APPARATUS

(75) Inventor: Bernard Couderc, Annecy (FR)

(73) Assignee: Salomon S.A., Metz-tessy (FR)

( * ) Notice: Subject to any disclaimer, the term of this patent is extended or adjusted under 35 U.S.C. 154(b) by 0 days.

(21) Appl. No.: 11/325,471

(22) Filed: Jan. 5, 2006

(65) Prior Publication Data

US 2006/0170196 A1 Aug. 3, 2006

(30) Foreign Application Priority Data

Jan. 31, 2005 (FR) ..... 05 00927

(51) Int. Cl.
*A63C 5/03* (2006.01)

(52) U.S. Cl. ..... 280/607; 280/14.22

(58) Field of Classification Search ..... 280/607, 280/602, 14.22, 636, 11.28
See application file for complete search history.

(56) References Cited

U.S. PATENT DOCUMENTS 5,909,894 A * 6/1999 Meader et al. ..... 280/623
5,971,407 A 10/1999 Zemke et al.
6,520,511 B2 2/2003 Gonthier
6,604,754 B1 * 8/2003 Gyr ..... 280/602
6,644,681 B2 * 11/2003 Couderc et al. ..... 280/602
6,676,152 B2 * 1/2004 Gonthier ..... 280/623
7,021,647 B2 * 4/2006 Restani ..... 280/602
2001/0001520 A1 * 5/2001 Gyr ..... 280/14.22
2001/0002083 A1 * 5/2001 de France ..... 280/607
2001/0010418 A1 8/2001 Gonthier
2002/0163162 A1 * 11/2002 Haupt ..... 280/618
2003/0025299 A1 * 2/2003 Noviant ..... 280/607
2003/0085550 A1 * 5/2003 Godde et al. ..... 280/617
2004/0026894 A1 * 2/2004 Gyr ..... 280/607
2006/0170196 A1 * 8/2006 Couderc ..... 280/607

FOREIGN PATENT DOCUMENTS

FR 2 824 275 A1 11/2002

* cited by examiner

*Primary Examiner*—J. Allen Shriver
(74) *Attorney, Agent, or Firm*—Greenblum & Bernstein, P.L.C.

(57) ABSTRACT

A device for receiving a foot or a boot onto a sports apparatus, the device including a support adapted to be located between the sole of the foot or the boot sole and the apparatus. The support includes a retractable abutment and a shock-absorbing arrangement, the abutment opposing the compression of the support up to a set value of the support compression force, the abutment retracting when the support compression force exceeds the set value, the shock-absorbing arrangement being biased beyond this set value.

21 Claims, 7 Drawing Sheets

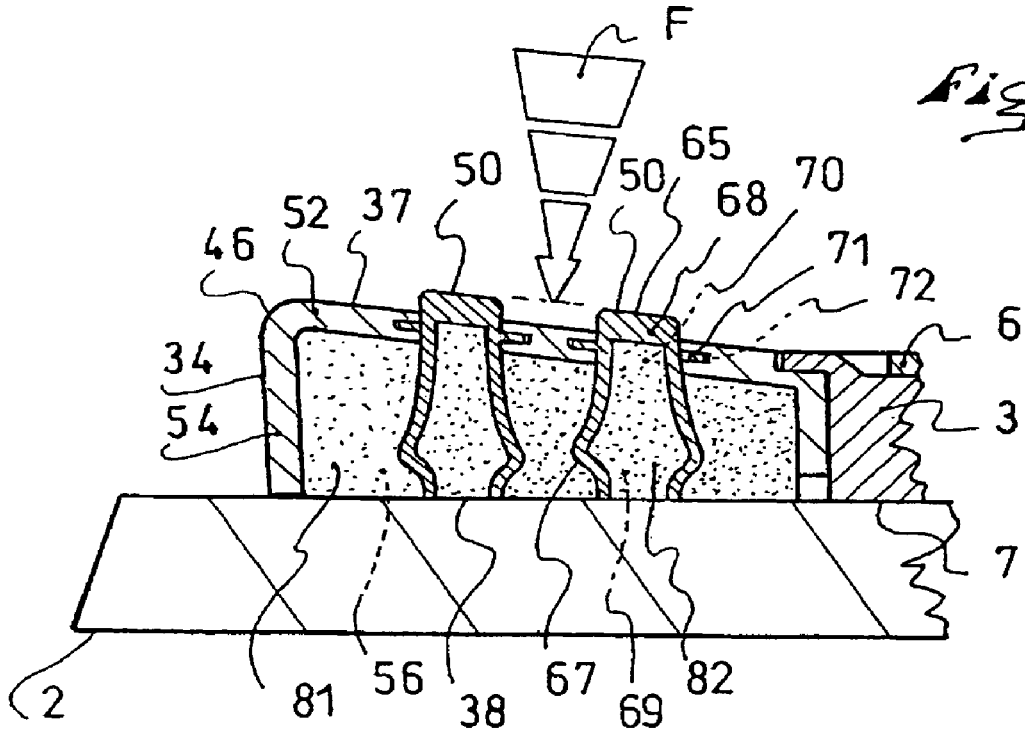
Fig. 5
Fig. 6
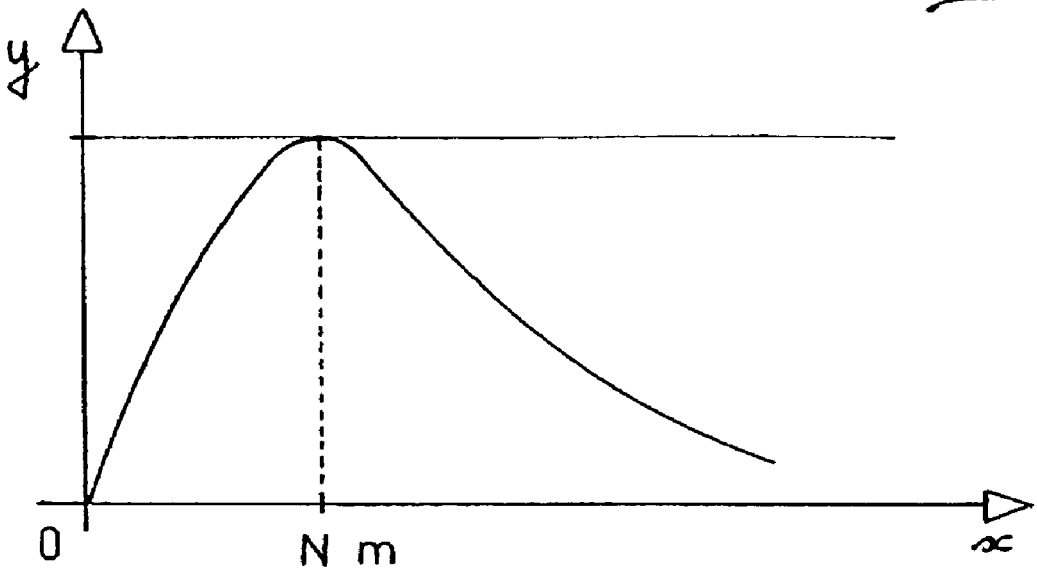

DEVICE FOR RECEIVING A FOOT OR A BOOT ON A SPORTS APPARATUS

CROSS-REFERENCE TO RELATED APPLICATION

This application claims priority under 35 U.S.C. §119 of French Patent Application No. 05.00927, filed on Jan. 31, 2005, the disclosure of which is hereby incorporated by reference thereto in its entirety.

BACKGROUND OF THE INVENTION

1. Field of the Invention

The invention relates to a device for receiving a foot or a boot onto a sports apparatus, and more specifically to a device provided with a support located between the sole of the foot or the boot sole and the apparatus.

More specifically, the invention relates to devices of the aforementioned type used for the practice of snowboarding, snow or water skiing, snowshoeing, roller-skating, or the like.

2. Description of Background and Relevant Information

Generally speaking, the support for the rider during use of an apparatus such as any of those mentioned above, affects the steering of the apparatus, because the support transmits steering forces/impulses or sensory information between the foot or the boot and the apparatus. In some cases, the support promotes precise steering whereas, in other cases, it rather allows for the filtering or damping of the impulses and sensory information.

In order to allow for precise steering, the support generally includes a relatively rigid wedge or spacer. The impulses and information then directly transit between the foot or the boot and the apparatus. Consequently, the damping of the impulses and information is minimal, or perhaps even non-existent, particularly beyond a certain intensity level of the impulses. Consequently, strong impulses or shocks are transmitted to the user, at least partially, which negatively affects the steering comfort.

This is true, for example in snowboarding where a rigid support toward the end of the feet allows for strong edge settings. An advantage is a precise steering, but in return, the comfort level is diminished, especially beyond a certain intensity threshold of the supports on the ground.

Conversely, to allow for the filtering or absorbing of the impulses and information, the support generally includes a relatively supple, or compressible, wedge or spacer. In such a case, the support filters or absorbs the impulses and information which are transmitted through it. Furthermore, the impacts are absorbed. All this allows for a more comfortable steering. However, the steering is consequently less precise.

This is true in snowboarding, for example, where a flexible or compressible support toward the end of the feet promotes the absorption of the impulses or impacts related to the steering. An advantage is comfortable steering, but in return, the precision of the intended path of movement is diminished since the edge settings are less strong.

Thus, the prior art has proposed various types of supports that each function according to a predetermined mode. Some of the supports transmit impulses or sensory information almost without absorbing them, or in any case, insufficiently absorbing them from a certain intensity threshold. Conversely, other supports absorb the impulses or the sensory information too much, to the detriment of precise steering.

Considering that during the various phases of a course, a user alternatively looks for precise steering and for shock absorption and comfort, a receiving device equipped with a support according to the prior art is efficient for only some of the phases of the course, i.e., the run from the top to the bottom of a slope, for example. In other words, the supports according to the prior art are not versatile. Consequently, the user chooses the support which suits him/her the best, knowing that the chosen support will not be optimal, or versatile, for all phases of the run.

SUMMARY OF THE INVENTION

One of the objects of the invention is to provide comfort for the user, if not in all phases of a run, at least in a greater number of phases. In other words, enhancing a support by allowing it to be more versatile, or even completely versatile.

To this end, the invention provides for a device for receiving a foot or a boot onto a sports apparatus, the device including a support intended to be situated between the sole of the foot or the boot sole and the apparatus.

The support of the receiving device of the invention includes a retractable abutment and a shock-absorbing arrangement, the abutment opposing the support compression up to a set value of the support compression force between the apparatus and the foot or the boot, the abutment retracting itself when the support compression force exceeds the set value, the shock-absorbing arrangement being biased beyond this set value.

Thus, due to the abutment, the steering impulses or the sensory information transit directly between the apparatus and the foot or boot. Also, with the retraction of the abutment beyond a set value of support compression force, the shock-absorbing arrangement comes into play and absorbs impulses or impacts related to the steering. As a consequence, the device according to the invention allows for precise steering when necessary, on the one hand, and for absorbing and more comfort when needed, on the other hand. The device is more versatile than the prior art and the user is more comfortable, and better-served by the device, along an increased number of phases of a run.

The foregoing advantages are particularly evident in snowboarding where, with the help of the device according to the invention, the steering impulses bias the apparatus or the board in the desired directions, and where impacts related to a collision with an obstacle or to a jump landing are well-absorbed.

This results in diverse advantages. In a non-limiting manner, such advantages include easier steering, diminished risks of traumatism, and less fatigue when using the apparatus.

BRIEF DESCRIPTION OF DRAWINGS

Other characteristics and advantages of the invention will be better understood from the description that follows, with reference to the annexed drawings showing, by way of non-limiting embodiments, how the invention can be embodied, and in which:

FIG. 5 is similar to FIG. 3, when part of the support is substantially compressed;

FIG. 6 is a graph representing the evolution of the intensity of the forces, which pass through the support, contingent on the applied compression forces;

DETAILED DESCRIPTION OF THE INVENTION

Although the embodiments of the invention described hereinafter are more particularly related to the field of snowboarding, it is to be understood that they also apply to other fields as previously mentioned.

The first embodiment of the invention is shown by means of FIGS. 1 to 6.

Figure 1:
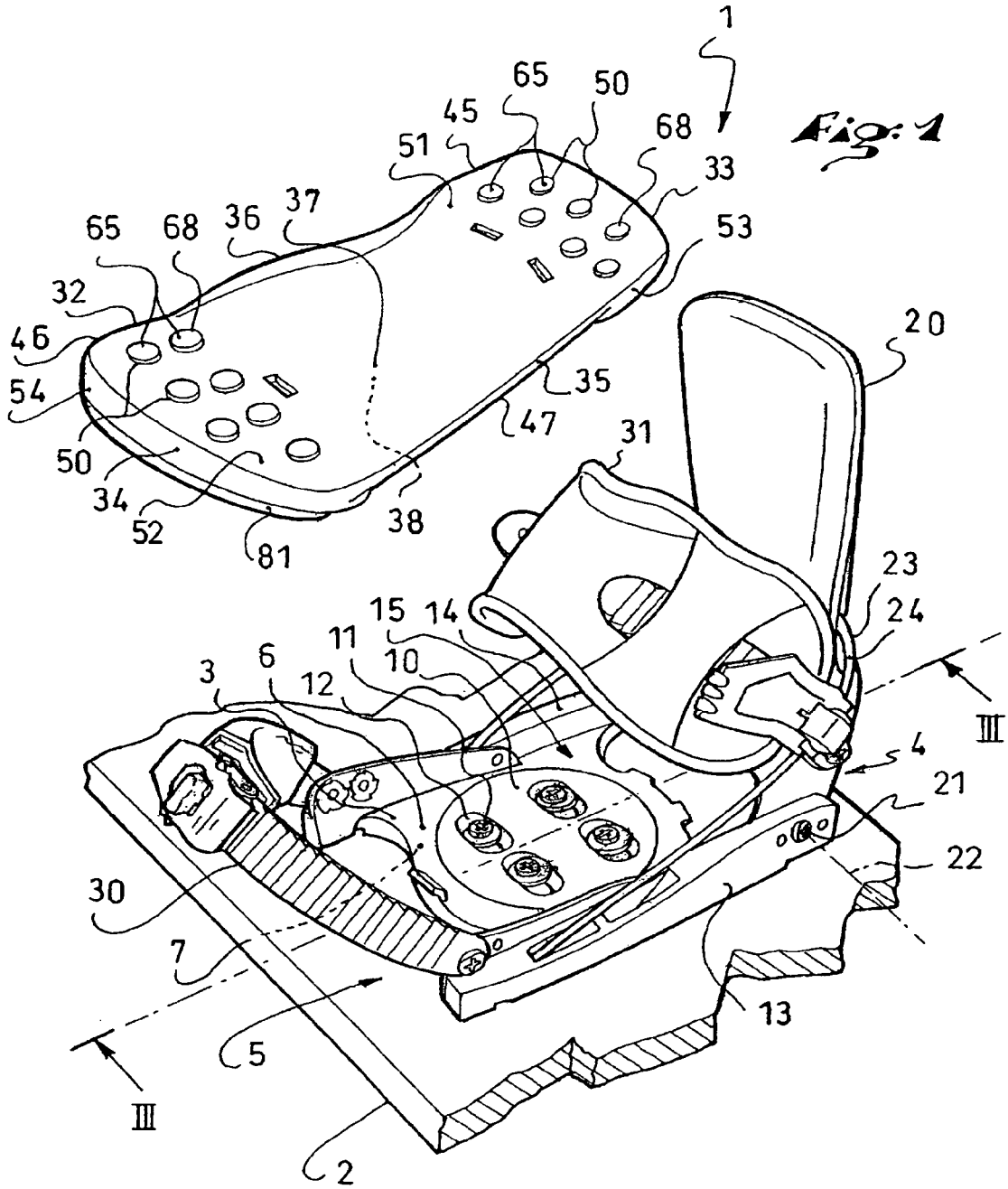
FIG. 1 is an exploded top perspective view of a receiving device according to a first embodiment of the invention.
Figure 2:
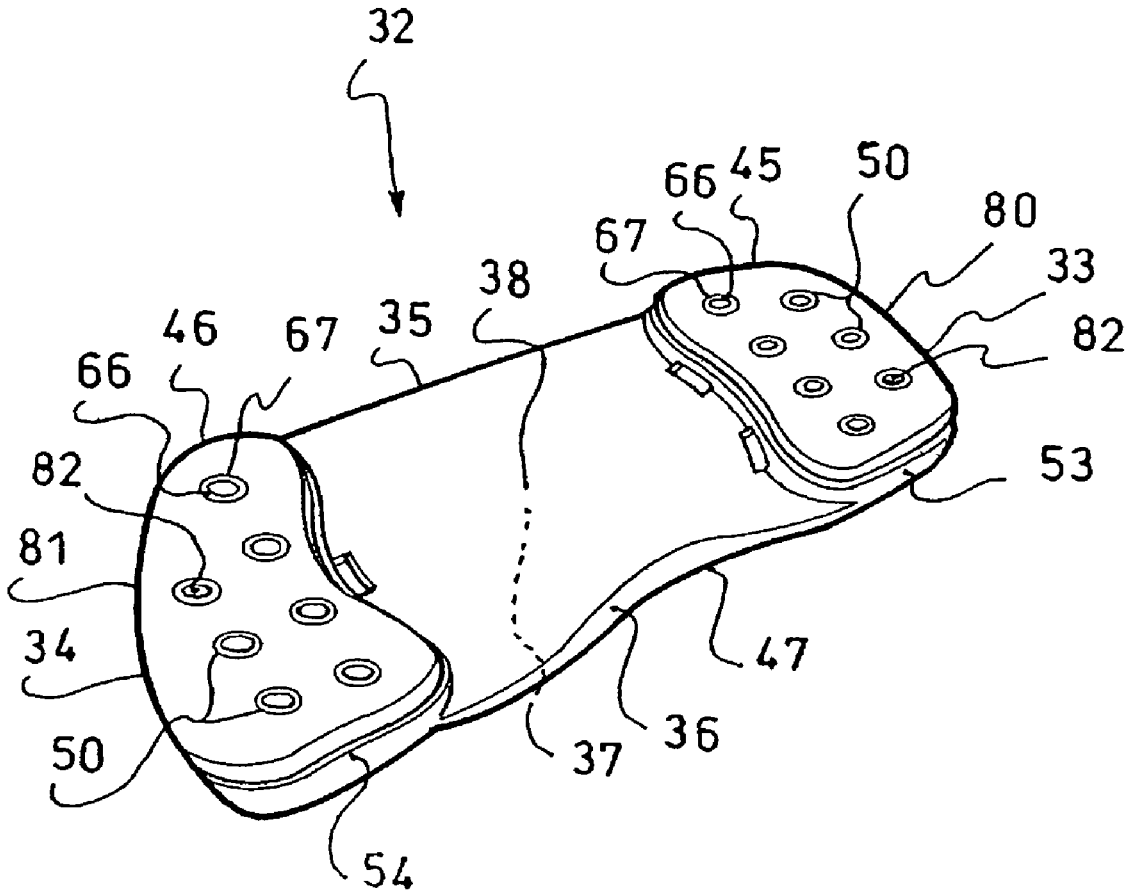
FIG. 2 is a perspective bottom view of the device of FIG. 1.

As shown in exploded perspective view in FIG. 1, the device 1 allows for temporarily receiving a boot (not shown) on a snowboard 2. The receiving device 1 is part of a snowboard binding.

In a known manner, the receiving device 1 includes a baseplate 3, which extends longitudinally between a rear end 4 and a front end 5.

The baseplate 3 includes a receiving surface 6 provided to be facing the sole of the boot, and a supporting surface 7 provided to be facing the board 2 and to take support thereon.

The baseplate 3 is secured to the board 2 by a means shown in the form of a disk 10, itself being secured to the board 2 by screws 11. The disk 10 is provided with slots 12 through which the screws 11 extend. For example, four slots 12 are provided for four screws 11, respectively, the screws being arranged at the four corners of a square. The slots 12 are parallel with one another to allow for a translational adjustment of the position of the disk 10 with respect to the board 2.

On the other hand, a different number of screws and slots could have been provided and the pattern made by the four screws and slots can be different. In an exemplary alternative, three screws could be arranged at the vertices of an equilateral triangle with three slots.

A minimum number of slots arranged in the disk are sufficient for the retaining function of the disk, but the advantage of an additional number of the slots is that they offer the possibility of adjusting the position of the baseplate on the board.

Other means for retaining the baseplate could be provided according to other alternatives.

The baseplate 4 is laterally bordered with a lateral flange 13 and a medial flange 14. Each of the flanges 13, 14 forms a lateral or a medial portion, respectively, of the device 1 to demarcate a zone 15 for receiving the boot. Once the boot is in position on the device 1, the flanges 13, 14 run laterally along the sole of the boot. The lateral and medial portions could be formed with something other than the flanges 13, 14. For example, mere lateral and medial abutments could be used.

The baseplate 3 and the flanges 13, 14 can be made as a one-piece unitary element made of synthetic material, for example. However, one could provide for the flanges to be affixed to the baseplate by any means, such as glue, welds, screws, by nesting, or the like.

The device 1 also includes a rear support element 20, or highback, that enables the rider's lower leg to be supported rearwardly.

According to the first embodiment of the invention, the rear support element 20 is associated with the flanges 13, 14, for example by means of an articulation 21 or pivot. The articulation 21 is substantially oriented along a transverse axis 22 of the device 1. The articulation 21 can include any such component as a screw, a rivet, a washer, a screw nut, a swivel pin, or the like.

The articulation 21 allows for the rear support element 20 to be moved closer to the baseplate 4. A resulting advantage is that storage is facilitated by enabling the support element 20 to be folded forwardly and downwardly.

As an alternative, the rear support element 20 could also be provided to be directly associated with the baseplate 3. The rear support element 20 could also be affixed to the apparatus directly, in this case, to the board 2. It only has to be positioned on the apparatus to provide rear support for the lower leg.

According to the first embodiment of the invention, an abutment 23 restricts the rearward rotation of the rear support element 20.

In a non-limiting manner, the abutment 23 includes a cable 24 that extends around the rear support element 20.

On the other hand, any other structure for making the abutment could be provided. For example, the abutment could include a connection arch between the flanges 13, 14 in order to oppose a backward move of the rear support element.

Two linkages adapted to removably retain the boot onto a baseplate 3, between the flanges 13, 14 in the receiving zone 15 are also provided for.

A first linkage 30 is located at the front at the forefoot, such as in the area of the metatarsophalangeal articulation when the foot is retained. A second linkage 31 is located towards the back, in the area of the instep when the foot is retained on the apparatus.

Each of the linkages 30, 31 extends transversely between the flanges 13, 14.

As an alternative, a different number of linkages could be provided.

The receiving device 1 also includes a support element 32, which is provided to be located between the sole of the foot or the boot sole and the apparatus.

According to the first embodiment of the invention, the support element 32 is adapted to cover the entire baseplate 3 and to extend in the entire receiving zone 15. To do so, the support 32 extends length-wise between a rear end 33 and a front end 34, width-wise between a lateral edge 35 and a medial edge 36, and depth-wise between a receiving surface 37 and a support surface 38. The receiving surface 37 is adapted to receive a foot or a boot, the support surface 38 being adapted to face the baseplate 3 and to be supported on the baseplate and the board 2, directly or indirectly.

The support element 32 thus constitutes an interface between almost the entirety of the sole of the boot and the baseplate 3. A resulting advantage is that it provides the boot or the foot with continuous stability.

The support element 32 also covers the disk 10. This protects the disk 10, the screws 11 and the slots 12 from outer aggressions, such as impacts and sources of abrasion. For example, the support element 32 prevents the slots 12 from being partially or entirely blocked by foreign matter.

According to the first embodiment of the invention, the support element 32 includes a first portion 45 and a second portion 46. As seen clearly in FIGS. 2 and 3, the first 45 and second 46 portions are rear and front parts respectively. The rear portion 45 is adapted to support the heel, while the front part 46 supports the boot in the areas of the toes and the metatarsus. To provide structural unity to the support, a bridge 47 is provided and connects the rear 45 and front 46 portions to one another. The bridge 47 covers, at least in part, the disk 10 and the baseplate 3. The rear 45 and front 46 portions are in direct contact with the board 2, the portions 45, 46 adjoining the baseplate 3.

The foregoing is not the only possible arrangement. One could also provide for one or the two portions 45, 46 be supported on the baseplate 3. In such a case, each portion involved would be indirectly connected to the board.

According to the invention, the support element 32 includes at least one retractable abutment 50 and a shock-absorbing arrangement, the abutment 50 opposing the compression of the support up to a set value of support compression forces, the abutment 50 retracting when the support compression force exceeds the set value, the shock-absorbing arrangement absorbing the compression of the support element 32.

The abutment 50 enables the rider to transmit steering impulses to the board, and to perceive sensory information. Steering is therefore precise. The transmission of the impulses and information compressively biases the support. When the impulses or the information are too intense, at least one abutment retracts in favor of the shock-absorbing arrangement. The shock-absorbing arrangement takes over to transmit the impulses or the information while absorbing them. The compression of the damping means dissipates excessive energy that could have caused discomfort or, possibly, light traumatisms. The combination of the retractable abutment and of the shock-absorbing arrangement therefore limits the intensity of the impulses or information. As a result, the rider can steer the board with the necessary accuracy under good comfort and safety conditions.

According to the first embodiment of the invention, as understood from FIGS. 1 to 6 and the present description, each of the rear 45 and front 46 portions includes a plurality of retractable abutments 50. For example, seven abutments are provided at the rear and seven abutments at the front, although these numbers could be smaller or larger. One could also provide for having abutments 50 at the rear only, or at the front only.

Each portion 45, 46 includes a rear 51 or front 52 plate, respectively. The plates 51, 52 partially demarcate the receiving surface 37 of the support element 32. In addition, each rear 45 or front 46 portion includes a rear 53 or front 54 edge extending from the plate 51, 52 away from the receiving zone 37. Each rear 53 or front 54 edge substantially extends to the periphery of the rear 51 or front 52 plate. The edge 53 and the rear plate 51 demarcate a rear cavity 55 opened on the side of the supporting surface 38. By analogy, the edge 54 and the front plate 52 demarcate a front cavity 56 opened on the side of the supporting surface 38. Each edge 53, 54 extends continuously. One could, however, provide for one or the two edges 53, 54 to extend discontinuously.

According to the first embodiment of the invention, the bridge 47, the rear 51 and front 52 plates, as well as the rear 53 and front 54 edges, form a unitary one-piece element made of plastic material, for example, such as polyurethane, polyamide, polyethylene, or the like. This facilitates the manufacture of the support element 32. These elements 47, 51, 52, 53, 54 could be distinct and associated by any means.

In the area of the rear 45 or the front 46 portion of the support element 32, an abutment 50 allows for connecting the sole of the foot or of the boot sole and the board 2. Indeed, the abutment 50 longitudinally extends along a first end 65, known as the receiving end, and a second end 66, know as the supporting end. The first end 65 is adapted to be in contact with the foot or the boot, while the second end 66 is supported on the board 2. Thus, the connection between the boot and the board 2, via the abutment 50, is direct. An indirect connection could also be provided instead, the abutment taking support, for example, on the baseplate 3.

Each abutment 50 includes an elongated hollow body 67, which extends from the first end 65 to the second end 66. The hollow body 67 is made in the form of a tube, the cross-section of which is circular, for example. Other cross-section shapes are also possible. The cross-section of the abutment 50 is substantially constant, at least over a portion of its length. But one could also provide for the cross-section to vary.

The hollow body 67 is closed by a cap 68 on the side of the first end 65, but open on the side of the second end 66. Thus the hollow body 67 demarcates a cavity 69 that is open toward the second end 66. The contrary could also be provided, the cavity 69 then opening out toward the first end 65.

The hollow body 67 and the cap 68 form, for example, a unitary one-piece element, but they could also be provided to be associated with another by any means.

The hollow body 67 and the cap 68 are made of a synthetic material, for example, such as polyethylene, polyurethane, or any similar material.

An abutment 50 is associated with a rear 51 or a front 52 plate by other means. The abutment 50 is, for example, inserted in an opening 70 of the plate 51, 52. The cross-section of the abutment 50 and the shape of the opening are substantially identical, which allows for a precise positioning of the abutment in parallel with the surface of the plate 51, 52. A stopping mechanism immobilizes the abutment 50 with respect to the plate 51, 52 across the latter. To create this stopping mechanism, the abutment 50 has a shoulder 71 in the area of the first end 65, and the opening 70 is locally enlarged by a groove 72. The shoulder 71 is housed in the groove 72 for the retaining of the abutment 50 lengthwise. One could associate an abutment 50 with a plate 51, 52, for example, by nesting the shoulder 71 in the groove 72, or by molding the plate around the abutment. Alternatively, the stopping mechanism could be made differently.

In a non-limiting manner, each abutment 50 is associated with a plate 51, 52 so as to be substantially perpendicular to the supporting surface 38. The forces compressing the support 32 thus transit substantially along the length of the abutment 50 which, in this illustrated embodiment, is a cylindrical wall that extends vertically when the bottom of the board 2 is supported on a horizontal surface. This allows the abutment 50 to oppose the forces without it being biased in an unbalancing direction.

To complete the rear 45 and front 46 portions, a rear and a front shock-absorbing arrangement has been provided respectively. Each shock-absorbing arrangement includes a rear 80 or front 81 block, the block 80 housed in the rear cavity 55 and the block 81 housed in the front cavity 56 of the rear 45 or front 46 portion. Each block 80, 81 at least partially fills the cavity 55, 56 by extending from the plate 51, 52 along the edge 53, 54, up to the supporting end 66 of each abutment 50. Each block 80, 81 extends from the first 65 to the second 66 end of an abutment 50. On the side of the supporting surface 38 of the support element 32, the block 80, 81 is leveled with the end 66 of each abutment 50. Thus, a given abutment 50 is in contact with the block 80, 81 over the entire length comprised between the plate 51, 52 and the end 66, that is over the entire length located under the plate. In a complementary manner, each shock-absorbing arrangement includes a least one plug 82 that at least partially fills up the cavity 69 of the abutment.

A block 80, 81 or a plug 82 is made of a reversibly deformable absorption material, which may be as a plastic foam material such as polyurethane, polyamide, or any similar material. Thus, when it is compressively biased, a block 80, 81 or a plug 82 can be crushed; but when the compression stops, the blocks/plug 80, 81, 82 can recover its initial shape. This allows for a good understanding of the functioning of the receiving device according to the invention.

Figure 3:
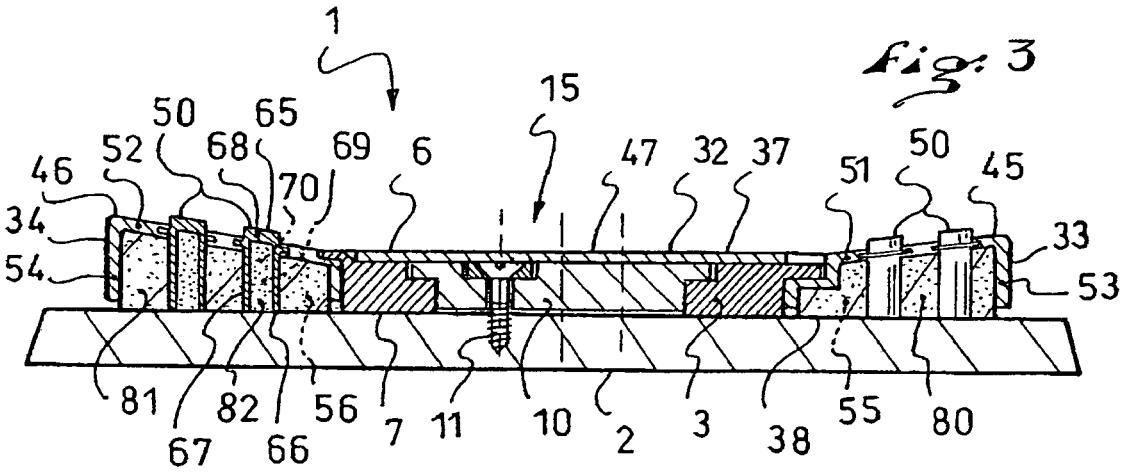
FIG. 3 is a partial cross-sectional view along the line III-III of FIG. 1, in the case where the support is assembled with the remainder of the device.
Figure 4:
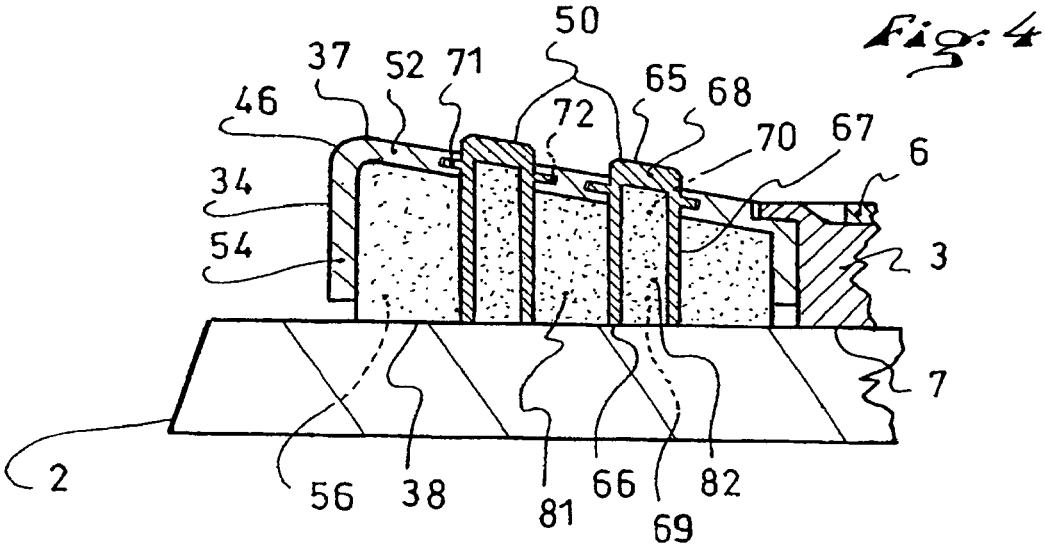
FIG. 4 is a partial enlargement of FIG. 3 emphasizing part of the support of the device when the support is slightly compressed or non-compressed.
Figure 7:
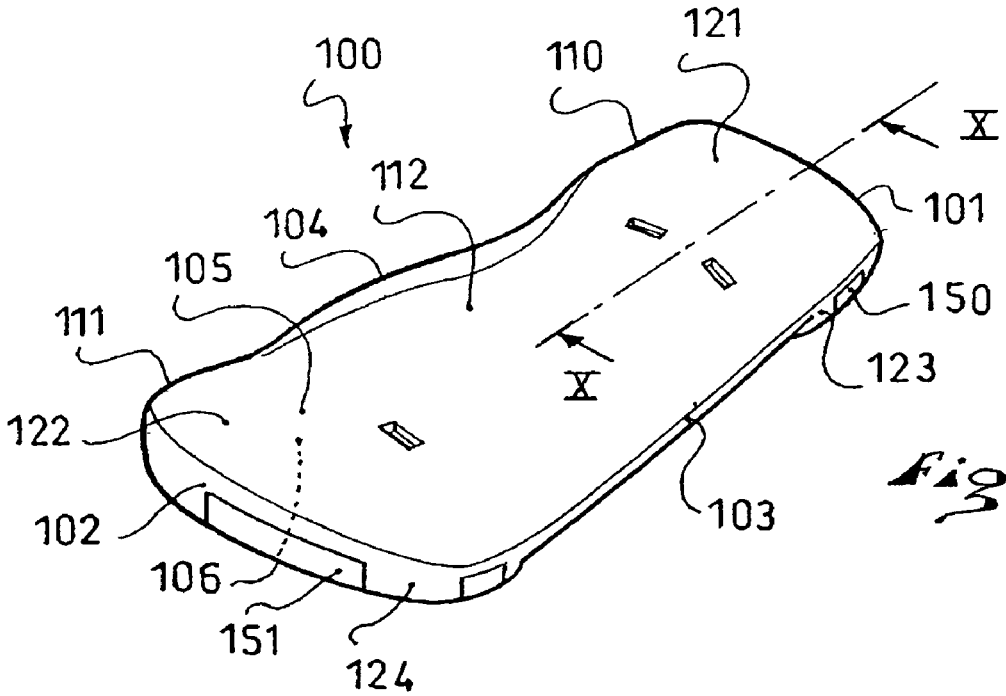
FIG. 7 is a perspective top view of a support for a receiving device, according to a second embodiment of the invention.
Figure 8:
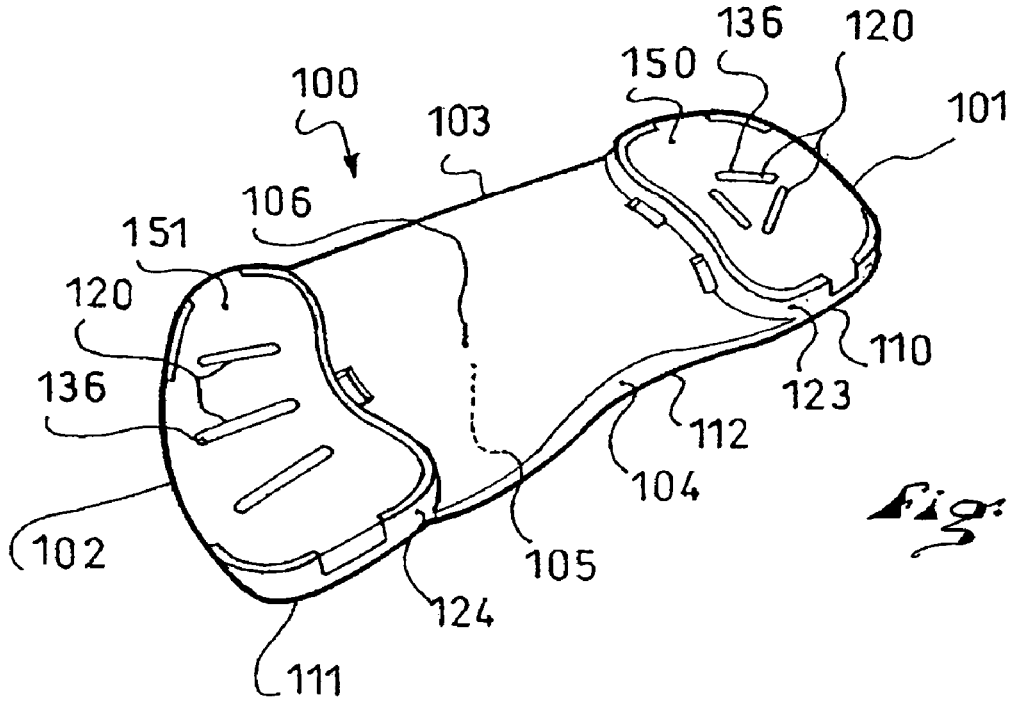
FIG. 8 is a non-exploded, bottom perspective view of the support of FIG. 7.
Figure 9:
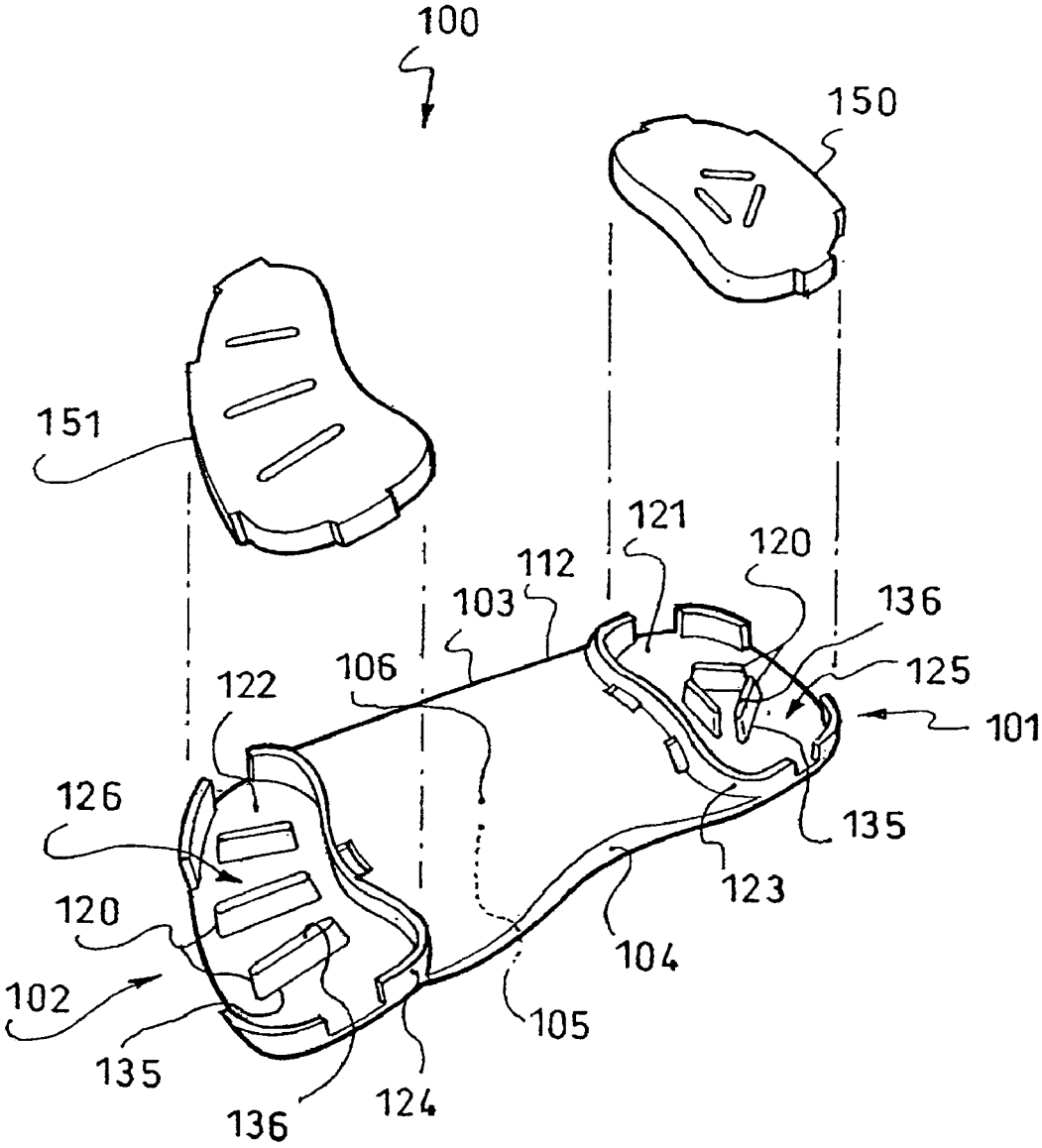
FIG. 9 is a view similar to FIG. 8, but in an exploded perspective view.

In FIGS. 3 and 4, the support element 32 of the device 1 is in a balanced position. The intensity of the impulses and other forces, which transit between the boot and the board 2, via the support element 32, is insufficient to trigger a significant compression of the abutments 50. In such case, the impulses and the forces are directly transmitted by the support element 32, without dissipation of energy. As a result, the steering of the board is precise.

FIG. 5 corresponds to a case where impulses or forces along the direction of arrow "F", trigger a more or less substantial compression of the support element 32. The intensity of the impulses or the forces momentarily exceeds a set value. This value is considered to be a limit from which—and beyond which—steering becomes uncomfortable. In this case, at least one abutment 50 retracts, reversibly and flexibly deforming. In this case, according to the first embodiment of the invention, at least one abutment 50 deforms by buckling, that is, it becomes laterally compressed or deformed while being subject to a normal compression force. A normal force is a force oriented lengthwise of the abutment 50, from one end 65 to the other 66. From the moment when the abutment 50 has begun to retract, the shock-absorbing arrangement absorbs the compression of the support element 32. The block 80, 81 and at least one plug 82 are compressed by the forces applied thereto. As a result, the blocks/plug 80, 81, 82 dissipate at least part of the energy related to the compression. Thus, steering the board 2 remains comfortable.

According to the first embodiment of the invention, a peripheral edge 53, 54 of the rear 45 or front 46 portion is provided to limit the compression of the support element 32. To do so, the edge 53, 54 takes support on the board 2 starting from a certain level of compression of the absorbing arrangement. This is possible because the edge 53, 54 is in retreat with respect to the block 80, 81. This enables the abutment 50 to deform only elastically, without reaching the field of irreversible plastic deformation.

The variation in the intensity of the compression forces, which transit via the support 32, is shown in FIG. 6. In the chart shown, an x-axis "0x" corresponds to the intensity of the impulses or forces exerted on the support element 32. The intensity increases as it moves away from the origin "0". The y-axis "0y" corresponds to the intensity of the forces that transit via the support element 32. One can note that up until a set value or a nominal value "Nm", the impulses or the forces the support element 32 is subject to substantially integrally transit. Between "0" and "Nm" the abutments 50 are substantially not deformed, or are very slightly deformed. Beyond the nominal value "Nm", however, the impulses and the forces exerted on the support element 32 no longer transit integrally. The abutments 50 are retracted and the elastic material/mechanism dissipates energy.

A second embodiment of the invention is shown in FIGS. 7 to 11. To simplify matters, only the elements specific to this embodiment will be pointed out.

The second embodiment also includes a support element 100, which extends length-wise between a rear end 101 and a front end 102, width-wise between a lateral edge 103 and a medial edge 104, and depth-wise between a receiving surface 105 and a supporting surface 106. The support 100 has a first portion 110 and a second portion 111 connected to another by a bridge.

According to the invention, the support element 100 includes at least one retractable abutment 120 and one absorbing arrangement, the abutment 120 opposing the compression of the support up to a set value of the support compression forces, the abutment 120 retracting when the compression force of the support exceeds the set value, the absorbing arrangement being biased beyond this set value.

According to the second embodiment of the invention, each of the rear 110 and front 111 portions includes a plurality of retractable abutments 120. For example, three abutments are provided at the rear and three abutments at the front, although these numbers could be smaller or larger.

Each portion 110, 111 includes a rear plate 121 and a front 122 plate, respectively, as well as a rear 123 or front 124 edge extending from the plate 121, 122. The edges 123, 124 and the plates 121, 122 demarcate rear 125 and front 126 cavities, which are open on the side of the supporting surface 106. The edges 123, 124 are each discontinuous but that they could also be continuous.

An abutment 120 connects the sole of the foot or the boot sole to the board. The abutment 120 longitudinally extends between a first end 135 and a second end 136. In this illustrated embodiment, the abutment is a wall that extends vertically when the bottom of the board 2 is supported on a horizontal surface.

Each abutment 120 is shaped like a blade, which extends between the ends 135, 136. The abutment 120 projects from the plate 121, 122 on the side of the supporting surface 106. Thus each abutment 120 at least partially extends in the cavity 125, 126.

An abutment 120 is associated with a rear 121 or front 122 plate by any means. For example, the abutment 120 and the plate 121, 122 form a unitary one-piece element. This element is made here using a plastic material, but it could be made of metal. The abutment can also be attached on the plate 121, 122 by any means.

In a non-limiting manner, each abutment 120 is associated with a plate 121, 122 so as to be substantially perpendicular to the supporting surface 106.

A rear and a front shock-absorbing arrangement includes a rear block 150 and a front block 151, respectively, with rear block 150 being housed in the rear cavity 125, and front block 151 being housed in the front cavity 126. Each block 150, 151 extends from the plate 121, 122 along the edge 123, 124, up to the second end 136 of each abutment 120. On the side of the supporting surface 106 of the support element 100, the block 150, 151 is flush with the end 136 of each abutment 120.

Here as well, when compressively biased, a block 150 or 151 can be crushed; but when the compression stops, the block 150 or 151 can recover its initial shape.

Figure 10:
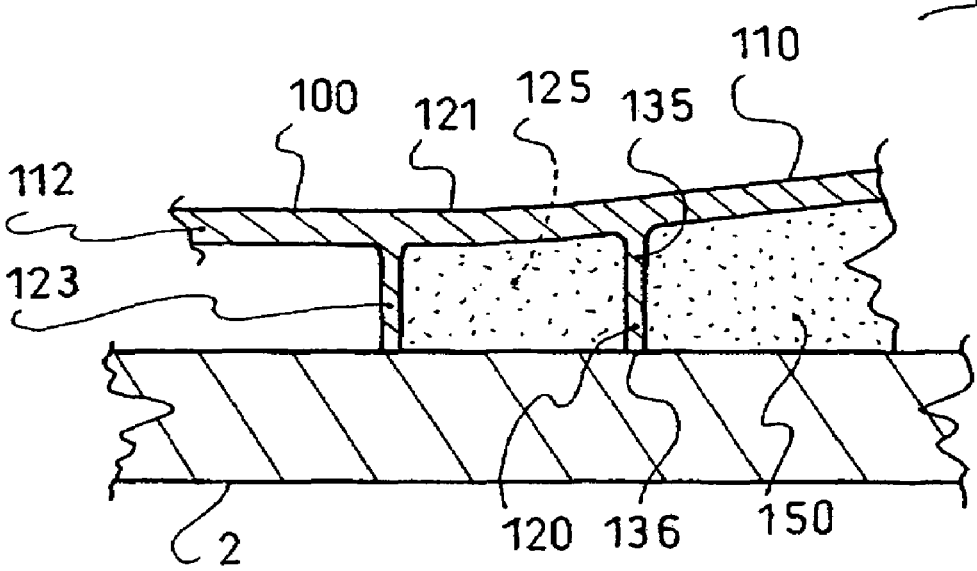
FIG. 10 is a partial cross-section along the line X-X of FIG. 7, when part of the support is slightly compressed or non-compressed.

FIG. 10 shows the support element 100 in a balanced position. Each abutment 120 is straight, which enables a direct transmission of the impulses and of the forces by the support element 100. There is substantially no dissipation of energy.

Figure 11:
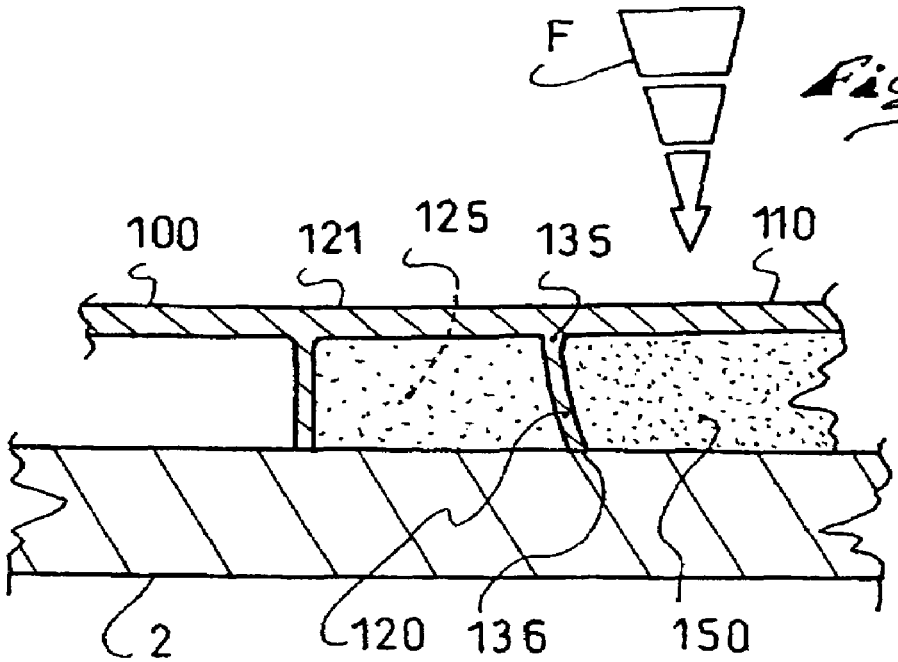
FIG. 11 is similar to FIG. 10, when the support portion is substantially compressed.

Conversely, FIG. 11 shows impulses and forces that crush or compress the support 100. In this case, at least one abutment 120 retracts by reversibly becoming elastically deformed. In this case, according to the second embodiment of the invention, at least one abutment 120 becomes flexionally deformed. More precisely, the second end 136 moves laterally whereas the first 135, which is affixed to the plate 121, 122, stays in place. From the moment the abutment 120 has begun to retract, the absorbing arrangement absorbs the compression of the support element 100. The block 150, 151 is compressed by the forces applied thereto. As a result, the blocks 150, 151, dissipate at least part of the energy related to the compression.

From a general standpoint, the invention is embodied from materials and implementation techniques known to the one having ordinary skill in the art.

The invention is not limited to the particulars of the embodiments hereinabove described and include all of the technical equivalents that are encompassed by the scope of the following claims.

In particular, other structures for the abutments and the shock-absorbing arrangement can be provided.

The plates 51, 52, 120, 121 form an angle with the supporting surface 38, 106 of the support element 32, 100. However, one or the two plates can also be provided to be parallel to the supporting surface 38, 106.

The invention claimed is:

1. A device for receiving a foot or a boot onto a sports apparatus, the device comprising:

a support adapted to be located between the sole of the foot or the boot sole and the apparatus;

the support comprising at least one retractable abutment and a shock-absorbing arrangement;

the at least one retractable abutment opposing compression of the shock-absorbing arrangement up to a set value of a support compression force, the abutment being configured and arranged to be retracted when the support compression force exceeds the set value, the shock-absorbing arrangement being biased only beyond said set value.

2. A receiving device according to claim 1, wherein:

the abutment has an elongated, hollow body extending from a first end to a second end.

3. A receiving device according to claim 1, wherein:

the abutment is blade-shaped and extends between a first end and a second end.

4. A receiving device according to claim 2, wherein:

the abutment is substantially perpendicular to a surface for supporting the device, the abutment opposing the support compression forces without being biased in an unbalanced manner.

5. A device for receiving a foot or a boot onto a sports apparatus, the device comprising:

a support adapted to be located between the sole of the foot or the boot sole and the apparatus;

the support comprising a rear portion and a front portion, at least one of said portions including a plurality of retractable abutments and a shock-absorbing arrangement;

said retractable abutments opposing compression of the support up to a set value of a support compression force, said abutments being configured and arranged to be retracted when the support compression force exceeds the set value, the shock-absorbing arrangement being biased beyond said set value.

6. A receiving device according to claim 5, wherein:

one of said rear and front portions includes a plate, said plate partially demarcating a surface for receiving the support, the abutment being associated with the plate.

7. A receiving device according to claim 6, wherein:

one of said rear and front portions includes a rear or front edge extending from the plate, away from the receiving surface.

8. A receiving device according to claim 2, wherein:

the shock-absorbing arrangement includes a block, said block extending from the first to the second end of an abutment.

9. A receiving device according to claim 7, wherein:

a bridge connects the rear and front portions one to another.

10. A receiving device according to claim 1, wherein:

the retractable abutment is made out of a synthetic material; and the shock-absorbing arrangement is reversibly made of deformable material.

11. A snowboard binding including a receiving device according to claim 1.

12. A receiving device according to claim 1, wherein:

the abutment comprises a wall extending vertically when the device is mounted on a sports apparatus supported on a horizontal surface, said wall being structured and arranged for the following:

flexing and allowing said support to move downwardly only upon application of a force greater than said set value applied by a user to said support;

not flexing and not allowing said support to move downwardly upon application of a force less than said set value applied to said support; and the shock-absorbing arrangement comprises a reversibly compressible plastic foam for dissipating energy from a force greater than said set value applied by the user to said support.

13. A receiving device according to claim 3, wherein:

the abutment is substantially perpendicular to a surface for supporting the device, the abutment opposing the support compression forces without being biased in an unbalanced manner.

14. A receiving device according to claim 1, wherein:

the at least one retractable abutment is structured and arranged to oppose a force applied by a user on said support up to said set value during use of the support apparatus while said support does not move downward against said shock-absorbing arrangement.

15. A receiving device according to claim 1, wherein:

the shock-absorbing arrangement is structured and arranged to dissipate energy upon downward movement of the support;

during application of a force applied by a user on said support up to said set value during use of the support apparatus, said force is opposed by the at least one retractable abutment and said shock-absorbing arrangement does not dissipate energy.

16. A receiving device according to claim 5, wherein:

said plurality of retractable abutments are structured and arranged to oppose a force applied by a user on said support up to said set value during use of the support apparatus while said support does not move downward against said shock-absorbing arrangement.

17. A receiving device according to claim 5, wherein:

the shock-absorbing arrangement is structured and arranged to dissipate energy upon downward movement of the support;

during application of a force applied by a user on said support up to said set value during use of the support apparatus, said force is opposed by said plurality of retractable abutments and said shock-absorbing arrangement does not dissipate energy.

18. A device for receiving a foot or a boot onto a sports apparatus, the device comprising:

a support adapted to be located between the sole of the foot or the boot sole and the apparatus;

the support comprising at least one abutment and a shock-absorbing arrangement;

the at least one abutment opposing compression of the shock-absorbing arrangement up to a set value of a support compression force, the abutment being configured and arranged to be move toward said apparatus only when the support compression force exceeds the set value, the shock-absorbing arrangement being biased only beyond said set value.

19. A device for receiving a foot or a boot onto a sports apparatus, the device comprising:

a support for supporting the foot or boot of a user of the sports apparatus, said support adapted to be located between the sole of the foot or the boot sole and the sports apparatus, said support comprising:

means for enabling precise steering of said sport apparatus with said foot or boot, said means comprising means for supporting the foot or boot against moving toward the sports apparatus during use of the sports apparatus and while forces applied by the foot or boot are less than a set value;

means for at least partially dissipating only such forces applied by the foot or boot which are greater than the set value, said means for at least partially dissipating forces comprising means for allowing the foot or boot to move toward the sports apparatus.

20. A receiving device according to claim 19, wherein:

said means for enabling precise steering comprises at least one abutment for supporting the foot or boot of the user during use of the sports apparatus, said abutment comprising a wall extending vertically when the device is mounted on a sports apparatus supported on a horizontal surface, said wall being structured and arranged to flex and allow said support to move downwardly upon application of a force greater than said set value;

said means for at least partially dissipating forces applied by the foot or boot greater than the set value comprising an elastic compressible foam.

21. A snowboard binding including a receiving device according to claim 19.

* * * * *